US007917262B2

(12) United States Patent
Kuwahara et al.

(10) Patent No.: US 7,917,262 B2
(45) Date of Patent: Mar. 29, 2011

(54) CONTROL APPARATUS FOR VEHICLE

(75) Inventors: Seiji Kuwahara, Toyota (JP); Masato Kaigawa, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 904 days.

(21) Appl. No.: 11/883,769

(22) PCT Filed: Oct. 24, 2006

(86) PCT No.: PCT/JP2006/321601

§ 371 (c)(1),
(2), (4) Date: Aug. 6, 2007

(87) PCT Pub. No.: WO2007/049784

PCT Pub. Date: May 3, 2007

(65) Prior Publication Data

US 2008/0140283 A1 Jun. 12, 2008

(30) Foreign Application Priority Data

Oct. 26, 2005 (JP) ..... 2005-311294

(51) Int. Cl.
*F02D 29/00* (2006.01)

(52) U.S. Cl. ..... 701/36; 701/54; 701/51; 701/84; 180/233

(58) Field of Classification Search ..... 180/233; 701/36, 54, 70, 101, 103, 105
See application file for complete search history.

(56) References Cited

U.S. PATENT DOCUMENTS

| | | | | |
|---|---|---|---|---|
| 6,397,140 | B2 * | 5/2002 | Minowa et al. | 701/96 |
| 6,704,642 | B2 * | 3/2004 | Moriya et al. | 701/115 |
| 6,763,295 | B2 * | 7/2004 | Katakura et al. | 701/70 |
| 7,534,968 | B2 * | 5/2009 | English et al. | 174/382 |
| 2005/0137766 | A1 | 6/2005 | Miyakoshi et al. | |

FOREIGN PATENT DOCUMENTS

| | | |
|---|---|---|
| JP | A 3-42338 | 2/1991 |
| JP | A 5-256660 | 10/1993 |
| JP | B2 2828735 | 9/1998 |
| JP | A 2005-178626 | 7/2005 |
| RU | 2 076 049 C1 | 3/1997 |
| SU | 1390408 A1 | 4/1988 |

* cited by examiner

*Primary Examiner* — Thomas G Black
*Assistant Examiner* — Marthe Marc Coleman
(74) *Attorney, Agent, or Firm* — Oliff & Berridge, PLC

(57) ABSTRACT

An ECU executes a program that includes the steps of: sensing an accelerator position (S100); calculating a target engine torque of a manipulating system "a" from the accelerator position (S200); holding the target engine torque of the manipulating system "a" (S300); calculating a target driving force of the manipulating system "A" from the target engine torque of the manipulating system "a" (S400); arbitrating in driving force between the target driving force of the manipulating system "A" and the target driving force of the supporting system "B" (S500); and, if the target driving force of the manipulating system "A" is selected as a result of the arbitration (NO in S600), outputting the held target engine torque of the manipulating system "a" as the target engine torque to the engine ECU (S900).

3 Claims, 3 Drawing Sheets

CONTROL APPARATUS FOR VEHICLE

TECHNICAL FIELD

The present invention relates to a control apparatus for a vehicle incorporating a powertrain having an engine and an automatic transmission, and in particular, to a control apparatus for a vehicle that is suitably applicable to driving force control with which a driving force corresponding to a driver's requested driving force can be output.

BACKGROUND ART

As to a vehicle provided with an engine capable of controlling an engine output torque independently of a driver's accelerator pedal manipulation, and an automatic transmission, there is a concept of "driving force control", in which positive or negative target driving torque calculated based on a driver's accelerator pedal manipulated amount, vehicle driving conditions and the like is realized by the engine torque and a transmission gear ratio of the automatic transmission. Similar control schemes are those referred to as "a driving force request type", "a driving force demand type", and "a torque demand scheme".

An engine control apparatus of the torque demand scheme calculates a target torque of the engine based on an accelerator manipulation amount, an engine speed and an external load, and controls a fuel injection amount and an air supply amount.

In such an engine control apparatus of the torque demand scheme, practically, a loss load torque such as frictional torque that would be lost in the engine or the powertrain system is considered additionally to a requested output torque, to calculate a target generated torque. The fuel injection amount and the air supply amount are controlled to realize the calculated target generated torque.

According to the engine control apparatus of the torque demand scheme, the engine torque, which is the physical quantity directly effecting the control of the vehicle, is employed as the reference value of control. This improves the drivability, e.g., constant steering feeling is always maintained.

Japanese Patent Laying-Open No. 2005-178626 discloses a vehicle integrated control system that improves the fail-safe performance in such an engine control apparatus of the torque demand type. The vehicle integrated control system includes a plurality of control units controlling a running state of a vehicle based on a manipulation request, and a processing unit generating information to be used at respective control units in prohibiting an operation of a vehicle, based on information on a position of the vehicle and providing the generated information to each control unit. Each control unit includes sensing means for sensing an operation request with respect to at least one control unit, and calculation means for calculating information related to a control target to manipulate an actuator set in correspondence with each unit using at least one of the information generated at the processing unit and the sensed operation request.

According to the vehicle integrated control system, the plurality of control units include, for example, one of a driving system control unit, a brake system control unit, and a steering system control unit. The driving system control unit senses an accelerator pedal manipulation that is a request of a driver through the sensing means to generate a control target of the driving system corresponding to the accelerator pedal manipulation using a driving basic driver model, whereby a power train that is an actuator is controlled by control means.

The brake system control unit senses a brake pedal manipulation that is a request of the driver through the sensing means to generate a control target of the brake system corresponding to the brake pedal manipulation using a brake basic driver model, whereby a brake device that is an actuator is controlled by the control means. The steering system control unit senses a steering manipulation that is a request of the driver through the sensing unit to generate a control target of the steering system corresponding to the steering manipulation using a steering basic driver model, whereby a steering device that is an actuator is controlled by the control means. The vehicle integrated control system includes a processing unit that operates parallel to the driving system control unit, the brake system control unit and the steering system control unit that operate autonomously. For example, the processing unit generates: 1) information to be used at respective control means based on environmental information around the vehicle or information related to the driver, and provides the generated information to respective control units; 2) information to be used at respective control means to cause the vehicle to realize a predetermined behavior, and provides the generated information to respective control units; and 3) information to be used at respective control means based on the current dynamic state of the vehicle, and provides the generated information to respective control units. Each control unit determines as to whether or not such input information, in addition to the driver's request from the processing unit, is to be reflected in the motion control of the vehicle, and to what extent, if to be reflected. Each control unit also corrects the control target, and transmits the information among respective control units. Since each control unit operates autonomously, the power train, brake device and steering device are controlled eventually at respective control units based on the eventual driving target, braking target and steering target calculated from the driver's manipulation information sensed by the sensing unit, the information input from the processing unit, and information transmitted among respective control units. Thus, the driving system control unit corresponding to a "running" operation that is the basic operation of the vehicle, the brake system control unit corresponding to a "stop" operation, and the steering system control unit corresponding to a "turning" operation are provided operable in a manner independent of each other. The processing unit is applied with respect to these control units such that the driving operation corresponding to the vehicle environment, driving support for the driver, and vehicle dynamic motion control can be conducted automatically in a parallel manner. Accordingly, decentralized control is allowed without a master control unit that is positioned at a higher level than the other control units, and the fail safe faculty can be improved. Furthermore, by virtue of autonomous operation, development is allowed on the basis of each control unit or each processing unit. In the case where a new driving support function is to be added, the new function can be implemented by just adding a processing unit or modifying an existing processing unit. As a result, a vehicle integrated control system can be provided, having the fail-safe performance improved and capable of readily accommodating addition of a vehicle control function, based on integrated control, without realizing the entire control of the vehicle by, for example, one master ECU (Electronic Control Unit) as in the conventional case. In addition, as this processing unit, a unit generating information to be used in each control unit in prohibiting a sudden operation of a vehicle and providing the generated information to each control unit is arranged. For example, when the vehicle is parked in a vacant parking space in a parking lot, information that sudden acceleration/deceleration risk is "high" is generated and provided to each control unit. Upon receiving such information, each control unit controls the driving system control unit, the brake system control unit and the steering system control unit so as to prohibit a sudden operation. In this manner, the vehicle integrated control system capable of avoiding inadvertent sudden acceleration/deceleration can be provided.

In the integrated control system disclosed in the above-described Japanese Patent Laying-Open No. 2005-178626, a requested driving force (target driving force) of a manipulating system calculated from the position of the accelerator pedal manipulated by the driver and a requested driving force (target driving force) of a driving support system such as cruise control are arbitrated between each other, to generate an instruction value for controlling an actuator controlling the engine that is the driving power source or an actuator controlling the transmission ratio of the transmission.

Arbitration between such target values (requested values) from respective system must be carried out with a physical quantities of one unified unit (dimension) such as acceleration, driving force, torque and the like. This arbitration may result in an arithmetic error or the reduced number of significant figures because of the conversion and the reverse conversion, when the value must be returned to the original unit. Thus, a difference from the originally requested quantity may be generated. More specifically, when a requested torque of the manipulating system, i.e., an original target engine torque, must be arbitrated between a target driving force of the supporting system, the original target engine torque of the manipulating system must be converted into the target driving force of the manipulating system. The converted target driving force of the manipulating system and the target driving force of the supporting system without needing conversion are arbitrated between each other. If the target driving force of the manipulating system is selected as a result, the converted target driving force of the manipulating system is reversely converted to calculate the target engine torque of the manipulating system. Using the target engine torque of the manipulating system calculated by such reverse conversion, an actuator controlling the engine (such as the motor for driving the throttle valve) is controlled. Here, what becomes a concern is the poor accuracy of the target engine torque of the manipulating system obtained through reverse conversion and actually used in controlling the engine relative to the original target engine torque of the manipulating system. There is a problem that conversion into the unit of driving force and the reverse conversion into the unit of torque may invite an arithmetic error or the reduced number of significant figures, resulting in an error contained in the originally requested engine torque.

However, the vehicle integrated control system disclosed in Japanese Patent Laying-Open No. 2005-178626 is silent about such a problem.

DISCLOSURE OF THE INVENTION

The present invention has been made to solve the above-described problem, and an object thereof is to provide a control apparatus for a vehicle that includes arithmetic processing that realizes accurate processing in a system in which target values of a plurality of units are present, without incurring an arithmetic error from a conversion and a reverse conversion even when the conversion is performed for unifying the units for arbitrating between the target values.

A control apparatus according to the present invention controls a device incorporated into a vehicle. The control device generates a target value for the device, and arbitrates between at least two target values for one device to set a target value for the one device. At least one of the at least two target values is different in unit from the other target value. The control apparatus controls the one device based on the set target value. In the arbitration between the target values, the control apparatus performs a physical quantity conversion of the target value in order to unify units, holds the target value of before the physical quantity conversion, and sets the held target value as the target value for the one device, when the target value that requires a reverse conversion of the physical quantity conversion is selected as a result of the arbitration.

According to the present invention, for example when there are two target values for one device, the arbitration processing is performed, such as unifying units of the target values, and thereafter one of them is selected based on their magnitude. When the units are not unified, the unit conversion of physical quantities (physical quantity conversion) is performed so that the units are unified. Here, the target value before having its physical quantity converted is held. As a result of the arbitration, when the converted target value is reversely converted so that it is returned to the original unit, the held target value is set. This avoids setting of a target value that is deviated from the original target value because of the conversion and the reverse conversion. Specifically, the arithmetic of the physical quantity conversion may result in an arithmetic error being contained or the number of significant figures being reduced. The arithmetic of reverse conversion, which is performed after the arbitration when the value having its physical quantity converted is selected and the aforementioned reverse conversion of the physical quantity conversion becomes necessary (when the target for one device is to be determined by the original physical quantity), may also result in an arithmetic error being contained or the number of significant figures being reduced. Thus, the target value having its physical quantity converted and reversely converted contains a deviation from the original true target value. On the other hand, since the control apparatus sets the held (i.e., not being converted or reversely converted) target value to the target value for one device, the original target value (the true value itself) can be set. As a result, a control apparatus for a vehicle can be provide, that includes arithmetic processing that realizes accurate processing in a system in which target values of a plurality of units are present, without incurring an arithmetic error from a conversion and a reverse conversion even when the conversion is performed for unifying the units for arbitrating between the target values.

Preferably, the one device is a driving power source of the vehicle. In the generation of the target value, a first target value that is based on a manipulation of a driver of the vehicle, and a second target value that is based on other than the manipulation are generated. The first target value and the second target value are different in unit from each other.

According to the present invention, for example, the target value of the driving power source (solely the engine, solely the motor, and the motor and engine) of the vehicle is provided by a first target value based on a driver's manipulation, and by a second target value based on other than the driver's manipulation (for example, the drive supporting system such as cruise control). In such a case, an output torque is converted into the unit of driving force for the arbitration processing. The arbitration processing is performed between the first target value having its unit unified into the unit of the driving force and the second target value. When the first target value is selected, the first target value before the conversion is set to the target value for the driving power source. Since the value being converted and reversely converted is not set to the target value, an accurate target value can be set.

Further preferably, the driving power source is an engine. The first target value is expressed in the unit of torque. The second target value is expressed in the unit of driving force. In the physical quantity conversion, a physical quantity conversion for unifying into the unit of driving force is performed. In the holding of the target value, the first target value is held. In the setting of the target value, the held first target value is set as the target value for the engine, when the first target value is selected as a result of the arbitration.

According to the present invention, the first target value for the engine of the vehicle based on the driver's manipulation is provided in the unit of torque, whereas the second target value based on other than the driver's manipulation is provided in the unit of driving force. In such a case, the first target value is converted into the unit of driving force for performing the arbitration processing. The arbitration processing is performed between the first target value having its unit unified into the unit of the driving force and the second target value. When the first target value is selected, the first target value before the conversion is set to the target value for the driving power source. Since the value being converted and reversely converted is not set to the target value, an accurate target value can be set.

BEST MODES FOR CARRYING OUT THE INVENTION

Figure 1:
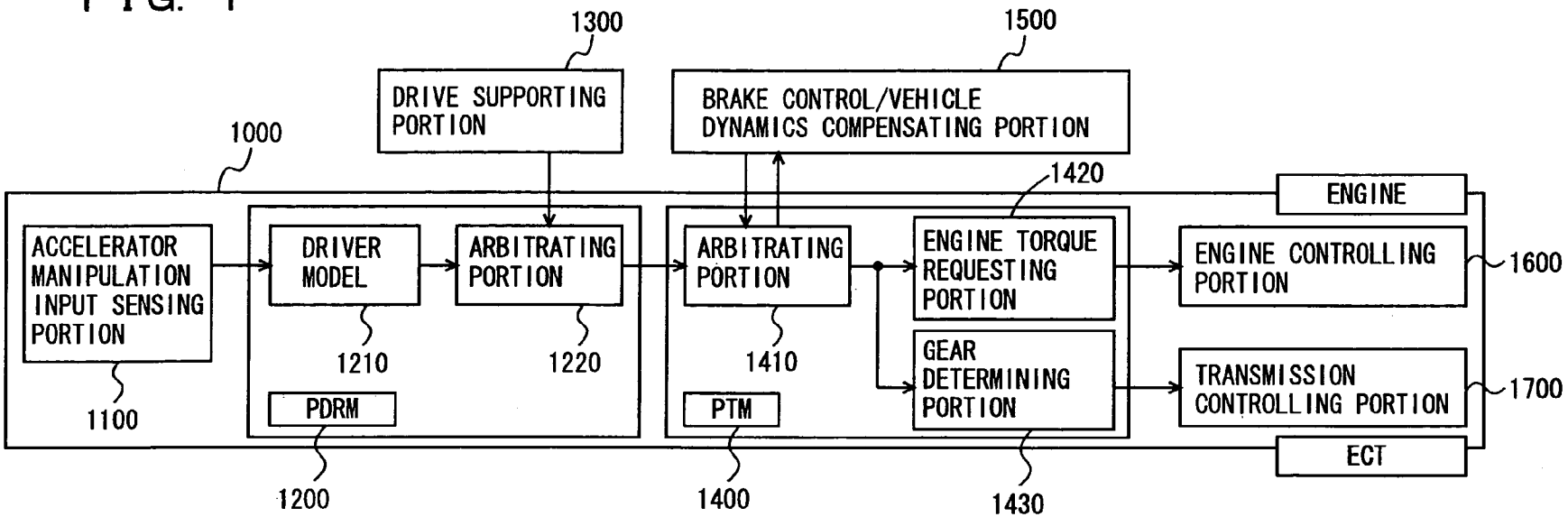
FIG. 1 is an overall block diagram of a driving force demand type controlling system to which a control apparatus according to the present embodiment is applied.

An embodiment of the present invention will be described hereinafter with reference to the drawings. The same elements have the same reference characters allotted. Their label and function are also identical. Therefore, detailed description thereof will not be repeated.

Referring to FIG. 1, an overall block of a vehicle control system 1000 in which general driving force control is exerted will be described. It is noted that the brake system, the steering system, the suspension system and the like are not shown.

A vehicle control system 1000 is constituted of an accelerator manipulation input sensing portion 1100, a PDRM (Power Train Driver Model) 1200, a PTM (Power Train Manager) 1400, an engine controlling portion 1600, and transmission (ECT (Electronically Controlled Automatic Transmission)) controlling portion 1700.

Accelerator manipulation input sensing portion 1100 senses the position of the accelerator pedal, which is the most common device with which the driver inputs an engine torque target value. Here, the sensed accelerator pedal position (hereinafter also referred to as accelerator position) is output to PDRM 1200.

PDRM 1200 includes a driver model 1210 and an arbitrating portion 1220. Based on the accelerator position sensed by accelerator manipulation input sensing portion 1100, a reference throttle position of the engine is calculated using maps and functions. Such maps and functions are of the nonlinear nature. Arbitrating portion 1220 arbitrates between, for example, a requested throttle position of the engine calculated by a drive supporting portion 1300 such as cruise control, and a reference throttle position calculated by driver model 1210. Arbitrating portion 1220 is for example realized by a function, such as a function that provides priority based on the current vehicle condition to one of the requested throttle position calculated by drive supporting portion 1300 and the reference throttle position calculated by driver model 1210, a function that selects the position opened greater, a function that selects the position opened smaller, and the like. While herein an arbitration between throttle positions is performed without performing a physical quantity conversion, an arbitration between driving forces that requires a physical quantity conversion prior to the arbitration will be described later referring to FIGS. 2 and 3. The control apparatus of the present invention is particularly suitably applied to such a case where a physical quantity conversion is required prior to an arbitration.

PTM 1400 includes an arbitrating portion 1410, an engine torque requesting portion 1420, and an ECT gear determining portion 1430.

Arbitrating portion 1410 arbitrates, for example, between a requested throttle position of the engine calculated at a brake control/vehicle dynamics compensating portion 1500 such as VSC (Vehicle Stability Control) and VDIM (Vehicle Dynamics Integrated Management), and a requested throttle position calculated by PDRM 1200. Similarly to arbitrating portion 1220, arbitrating portion 1410 is also for example realized by a function such as a function that provides priority based on the current vehicle condition to one of the requested throttle position of the engine calculated by brake control/vehicle dynamics compensating portion 1500 and the requested throttle position calculated by PDRM 1200, a function that selects the position opened greater, a function that selects the position opened smaller, and the like. Based on the requested throttle position arbitrated by arbitrating portion 1410, a requested engine torque TEREQ and a requested engine speed NEREQ are calculated by an engine torque requesting portion 1420, and a gear is determined by gear determination portion 1430. They will be detailed later.

Engine controlling portion 1600 controls the engine based on requested engine torque TEREQ and requested engine speed NEREQ being input from PTM 1400. Transmission controlling portion 1700 controls the ECT based on the gear being input from PTM 1400. It should be noted that, in the following description, while the ECT will be described as a gear type automatic transmission, it can be a CVT (Continuously Variable Transmission), in which case the gears correspond to transmission ratios. Each automatic transmission has a torque converter. The torque converter has its input side (the pump side) connected to the output shaft of the engine, and has its output side (the turbine side) connected to the input shaft of the automatic transmission.

Figure 2:
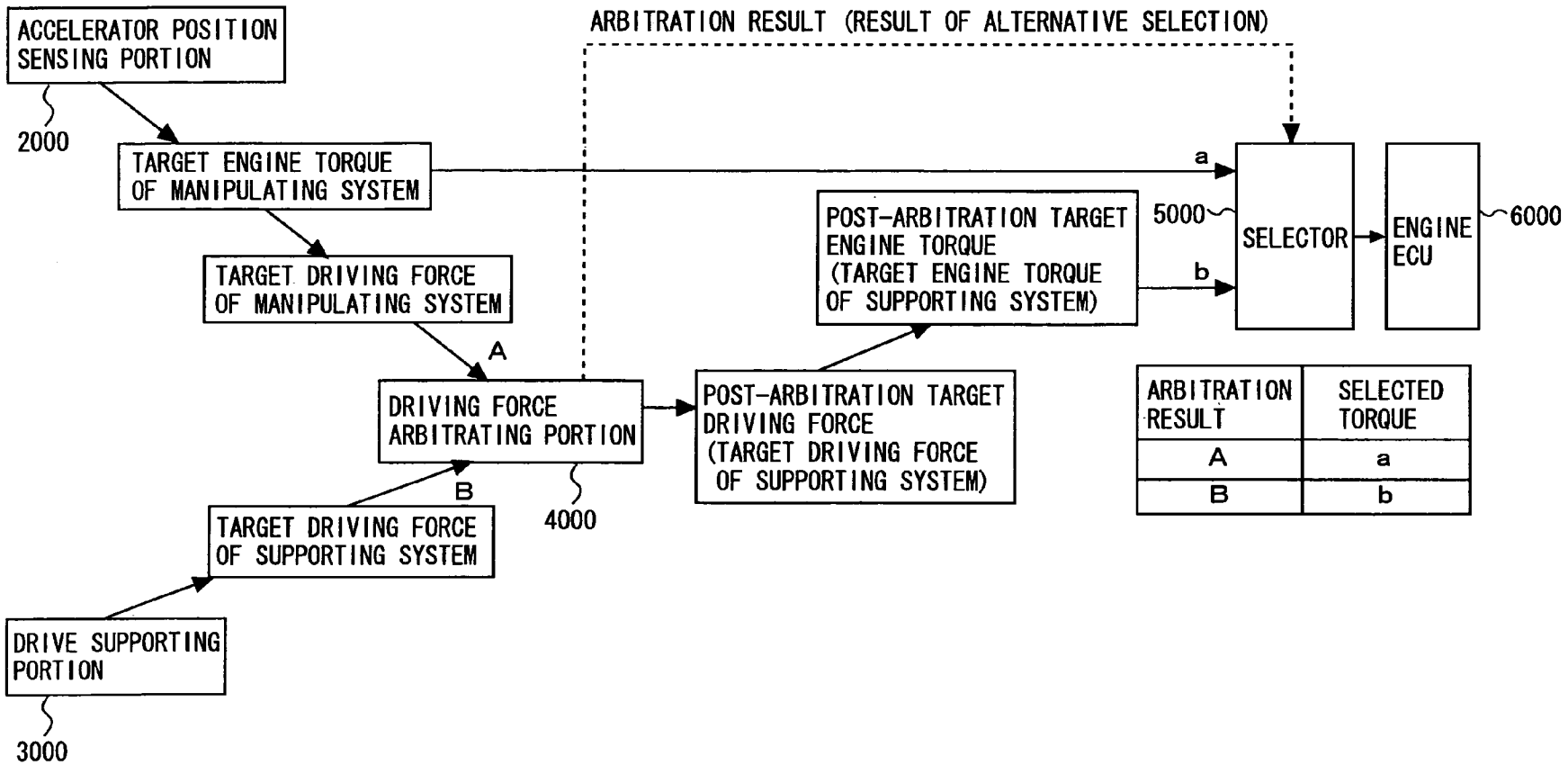
FIG. 2 is a conceptual view of a driving force arbitrating portion other than the arbitrating portion shown in FIG. 1.

Referring to FIG. 2, the driving force arbitration which is an arbitration different from that shown in FIG. 1 is described. In this arbitration processing, the arbitration must be carried out with physical quantities of one unified unit (dimension) (herein the driving force). It should be noted that, while the control apparatus of the present invention is suitably applied to such arbitration processing, the application of the present invention is not limited to the control of driving force of a vehicle.

Accelerator position sensing portion 2000 senses the position of the accelerator pedal manipulated by the driver, similarly to accelerator manipulation input sensing portion 1100 shown in FIG. 1. Based on the accelerator position sensed by accelerator position sensing portion 2000, a target engine torque of the manipulating system is calculated.

On the other hand, a drive supporting portion 3000, which is a drive supporting system such as cruise control, outputs a target driving force of the supporting system. The manipulating system is associated with the target engine torque, while the supporting system is associated with the target driving force, and thus their units are not unified. Accordingly, herein, the target engine torque of the manipulating system has its physical quantity converted into a target driving force of the manipulating system, to be arbitrated by driving force arbitrating portion 4000. It is noted that the target driving force of the supporting system may have its physical quantity converted into a target engine torque. The target engine torque of the manipulating system (the target engine torque of the manipulating system being denoted by "a") is held by a selector 5000.

The target engine torque of the manipulating system has its physical quantity converted into a target driving force of the manipulating system (the target driving force of the manipulating system being denoted by "A"), which is then arbitrated in the driving force between a target driving force of the supporting system (the target driving force of the supporting system being denoted by "B") by driving force arbitrating portion 4000. Driving force arbitrating portion 4000 arbitrates such that one of target driving force of the manipulating system (A) and target driving force of the supporting system (B) is alternatively selected. Driving force arbitrating portion 4000 outputs an arbitration result to selector 5000. It also outputs a post-arbitration target driving force such that, when target driving force of the supporting system (B) is selected, a target engine torque of the supporting system obtained by physical quantity conversion of target driving force of the supporting system (B) (the target engine torque of the supporting system being denoted by "b") can be input to selector 5000.

When selector 5000 is informed by driving force arbitrating portion 4000 that target driving force of the manipulating system (A) is selected, it outputs target engine torque of the manipulating system (a) held in selector 5000 as the selected torque to engine ECU 6000. On the other hand, when selector 5000 is not informed by driving force arbitrating portion 4000 that target driving force of the manipulating system (A) is selected, it outputs target engine torque of the supporting system (b) being input into selector 5000 as the selected torque to engine ECU 6000.

It is noted that the foregoing block diagram and the corresponding description are merely an example. For example, if it is not necessary for driving force arbitrating portion 4000 and selector 5000 to be separated, they may be integrated.

Figure 3:
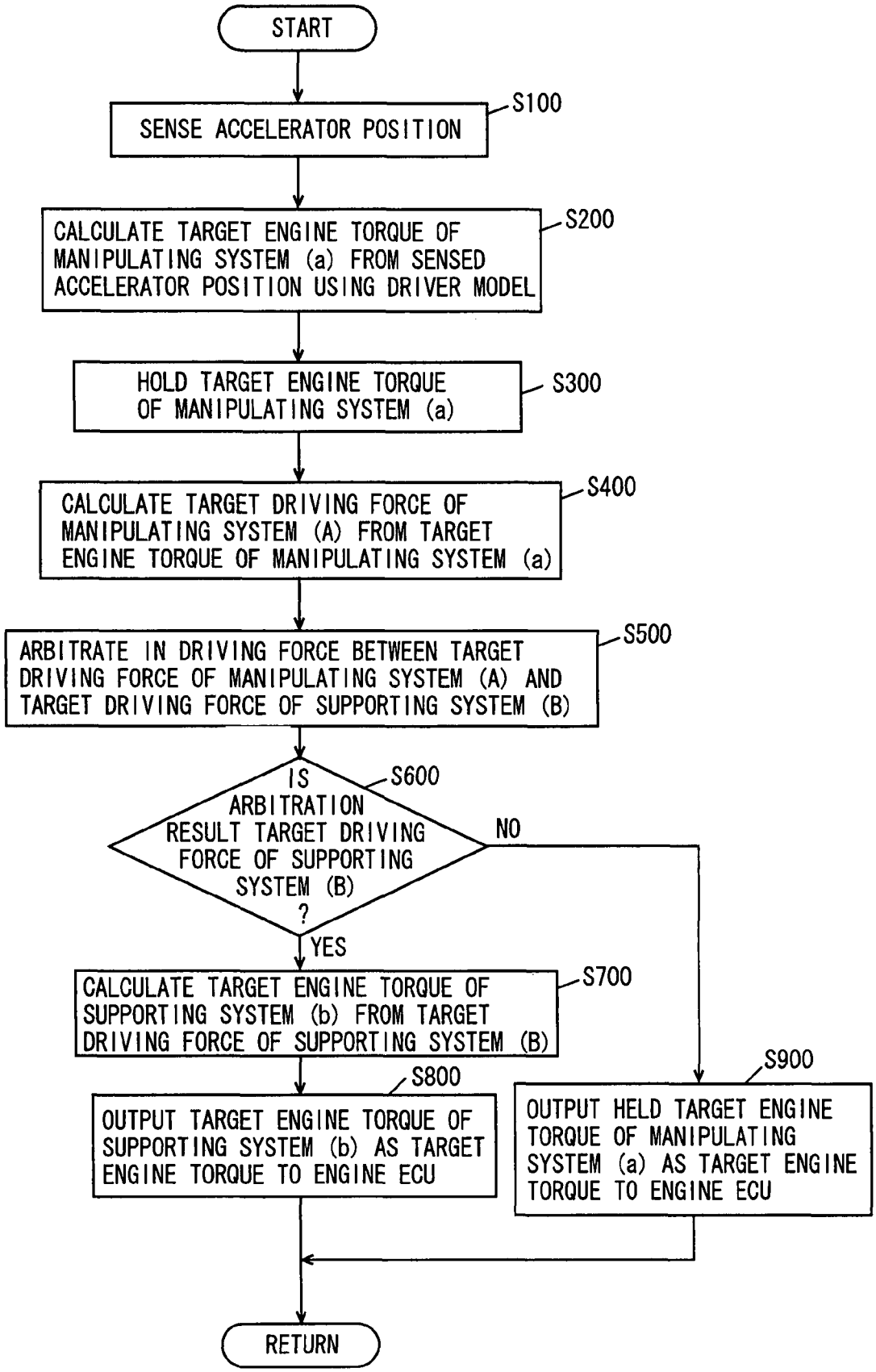
FIG. 3 is a flowchart showing a control structure of a program of driving force arbitration processing.

Referring to FIG. 3, a control structure of the program of driving force arbitration processing is described using a flowchart. In the following description, it is assumed that the driving force arbitration is performed by an ECU. Therefore, driving force arbitrating portion 4000 or selector 5000 can be considered as a software module implemented by the program executed by the ECU.

In step (hereinafter step is abbreviated as S) 100, the ECU uses accelerator position sensing portion 2000 to sense the position of the accelerator manipulated by the driver. In S200, the ECU uses the driver model to calculate target engine torque of the manipulating system (a) from the sensed accelerator position.

In S300, the ECU causes target engine torque of the manipulating system (a) to be held. As used herein, "to hold" means "to store data". In S400, the ECU calculates target driving force of the manipulating system (A) from target engine torque of the manipulating system (a). Here, the physical quantity conversion from torque to driving force is carried out. In S500, the ECU arbitrate in driving force between target driving force of the manipulating system (A) and target driving force of the supporting system (B), and selects one of them placing higher priority.

In S600, the ECU determines whether or not the arbitration result is target driving force of the supporting system (B). When the arbitration result is target driving force of the supporting system (B) (YES in S600), the process proceeds to S700. Otherwise (NO in S600), the process proceeds to S900.

In S700, the ECU calculates target engine torque of the supporting system (b) from target driving force of the supporting system (B). Here, the physical quantity conversion from driving force to torque is carried out. In S800, the ECU outputs target engine torque of the supporting system (b) as the target engine torque to engine ECU 6000.

In S900, the ECU outputs the target engine torque of the manipulating system (a) as the target engine torque to engine ECU 6000.

A driving force arbitrating operation by the ECU that is the control apparatus according to the present embodiment based on the foregoing structure and the flowchart is now described.

Operation of Calculating Target Driving Force of Manipulating System (A)

The accelerator position is sensed (S100). Using the driver model, target engine torque (a) is calculated from the accelerator position. The calculated target engine torque (a) is held for the occasion where the target driving force of the manipulating system is selected as a result of the driving force arbitration (S300).

Target engine torque of the manipulating system (a) has its physical quantity converted, and target driving force of the manipulating system (A) is calculated (S400). It is noted that even if target driving force of the manipulating system (A) has its physical quantity reversely converted, it would not return to target engine torque of the manipulating system (a). That is, because of an arithmetic error resulted from the conversion and the reverse conversion, there is no reversibility.

Arbitration Operation and Post-Arbitration Processing

Target driving force of the manipulating system (A) and target driving force of the supporting system (B) are arbitrated between each other. It is noted that drive supporting portion 3000 provides a target value in the unit of target driving force and therefore physical quantity conversion is not necessary.

If target driving force of the supporting system (B) is selected as a result of the arbitration, target driving force of the supporting system (B) has its physical quantity converted, and target engine torque of the supporting system (b) is calculated (S700). This target engine torque of the supporting system (b) obtained by the physical quantity conversion is output as the target engine torque to engine ECU 6000 (S800).

If target driving force of the manipulating system (A) is selected as a result of the arbitration, the held target engine torque of the manipulating system (a) is output as the target engine torque to engine ECU 6000 (S900). Here, even when target driving force of the manipulating system (A) is selected, target engine torque of the manipulating system (a) is not calculated from a physical quantity conversion of target driving force of the manipulating system (A), which has once been subjected to the physical quantity conversion (torque→driving force). As a result of the physical quantity conversion, target driving force of the manipulating system (A) contains an arithmetic error or has reduced number of significant figures. If target driving force of the manipulating system (A) that deviates from the true value has its physical quantity reversely converted to obtain target engine torque of the manipulating system (a), further arithmetic error or reduction in the number of significant figures would be invited. The deviation from the original target engine torque of the manipulating system (a) (i.e., original target engine torque of the manipulating system (a) refers to target engine torque of the manipulating system (a) calculated in S200) is greater. Not employing such target engine torque of the manipulating system (a) containing the deviation from the true value but employing the target engine torque of the manipulating system before having its physical quantity converted, the engine torque control can be exerted using the target engine torque without the deviation from the true value.

As above, according to the control apparatus of the present embodiment, as to the target value for the engine of the vehicle, the target value based on the manipulation of the driver is provided by the target engine toque (in the unit of torque) and the target value based on the drive supporting portion is provided by the target driving force (in the unit of force). The arbitration processing is performed after the target engine torque is converted into the unit of driving force. The arbitration processing is performed between the target value of the manipulating system and the target value of the supporting system unified in the unit of driving force. If the target value of the manipulating system is selected, the target value of the manipulating system before converted is set to the target value for the engine. Thus, a value converted and reversely converted is not used in setting the target value, and therefore an accurate target value can be set.

It should be understood that the embodiments disclosed herein are illustrative and non-restrictive in every respect. The scope of the present invention is defined by the terms of the claims, rather than the description and example above, and is intended to include any modifications and changes within the scope and meaning equivalent to the terms of the claims.

The invention claimed is:

1. A control apparatus for controlling a device incorporated into a vehicle, said control apparatus generating a target value for said device, and arbitrating between at least two target values for one device to set a target value for said one device, at least one of said at least two target values being different in unit from the other target value, said control apparatus controlling said one device based on said set target value, wherein in said arbitration between said target values, said control apparatus performs a physical quantity conversion of the target value in order to unify units, holds the target value of before said physical quantity conversion, and sets said held target value as the target value for said one device, when the target value that requires a reverse conversion of said physical quantity conversion is selected as a result of said arbitration.

2. The control apparatus for the vehicle according to claim 1, wherein said one device is a driving power source of the vehicle, and in said generation of the target value, a first target value that is based on a manipulation of a driver of the vehicle, and a second target value that is based on other than said manipulation are generated, said first target value and said second target value being different in unit from each other.

3. The control apparatus for the vehicle according to claim 2, wherein said driving power source is an engine, said first target value is expressed in the unit of torque, said second target value is expressed in the unit of driving force, in said physical quantity conversion, a physical quantity conversion for unifying into the unit of driving force is performed, in said holding of said target value, the first target value is held, and in said setting of said target value, said held first target value is set as the target value for the engine, when said first target value is selected as a result of said arbitration.

* * * * *